US006622727B2

(12) United States Patent
Perry

(10) Patent No.: US 6,622,727 B2
(45) Date of Patent: Sep. 23, 2003

(54) PERRY WEDGE PILLOW

(76) Inventor: Eric S Perry, 6441 Red Oak Dr., Troy, MI (US) 48098

( * ) Notice: Subject to any disclaimer, the term of this patent is extended or adjusted under 35 U.S.C. 154(b) by 0 days.

(21) Appl. No.: 10/068,020

(22) Filed: Feb. 5, 2002

(65) Prior Publication Data

US 2003/0145862 A1 Aug. 7, 2003

(51) Int. Cl.[7] ..... A61G 15/00

(52) U.S. Cl. ..... 128/845; 5/632; 5/636; 5/639; 5/645

(58) Field of Search ..... 128/845, 846, 128/869, 870; 5/630, 632, 637, 639, 652, 655, 733, 900.5

(56) References Cited

U.S. PATENT DOCUMENTS 2,700,779 A * 2/1955 Tolkowsky
3,883,906 A * 5/1975 Sumptor ..... 5/338
4,270,235 A * 6/1981 Gutmann ..... 5/436
4,850,067 A * 7/1989 Latorre ..... 5/436
5,479,667 A * 1/1996 Nelson et al. ..... 5/636

* cited by examiner

*Primary Examiner*—Michael A. Brown

(57) ABSTRACT

A wedge pillow that is placed under the patient to reduce the risk of hypoxia or aspiration associated with endotracheal intubation. The wedge pillow raises the angle of the thoracic spine and provides a platform and pressure point relief for the back of the head. This allows excessive and redundant tissue to fall away from the head and neck, thereby allowing excellent positioning, easy access to the oropharynx, and perfect sniffing position for direct visualization of the glottic opening. An extended arm cushion is also provided that may be used in conjunction with the wedge pillow to prevent or minimizes the amount of hyperextension of the arm at the shoulder joint during surgery. The arm cushion also provides pressure point relief to the arms keeps the arm from becoming malpositioned during surgery.

20 Claims, 1 Drawing Sheet

PERRY WEDGE PILLOW

TECHNICAL FIELD

The present invention relates generally to patient support systems, and more specifically to a wedge pillow and arm cushions for use in supporting patients during a surgical procedure.

BACKGROUND OF THE INVENTION

Most patients undergoing a surgical procedure under general anesthesia will require endotracheal intubation. Endotracheal intubation is done immediately after the patient is anesthetized. Endotracheal intubation is done by first placing a laryngoscope in the patient's mouth, allowing for a direct view of the glottis (vocal cords) where an endotracheal tube will be placed in order to ventilate the patient. The laryngoscope consists of a handle with a long metal blade or tongue attached to a light source. The blade is used to lift the tongue and surrounding structures such as the epiglottis or valecula so as to give the physician a clear view of the glottic opening.

To perform the intubation properly, it is first critical to ensure that the patient is correctly positioned to receive the laryngoscope. A sniffing position is required to align the oral, laryngeal, and pharyngeal axes and allows direct visualization of the glottic opening. However, it is extremely difficult to achieve this position in patients who are pregnant or obese, as it is difficult to access the patient's mouth and to maneuver the laryngoscope handle or blades. If endotracheal intubation is not performed quickly and correctly, the patient can become hypoxic (i.e. experience a lack of oxygen) due to lack of ventilation, leading to potentially serious consequences. Further, in the time between anesthetizing and correctly placing the endotracheal tube, a patient is at risk for aspirating gastric contents into their lungs. The risk for aspiration is particularly high for pregnant women and obese patients. The risk for aspiration is also high for patients with gastroesophogeal reflux disease, peptic ulcer disease, or a hiatal hernia.

To reduce the risk of hypoxia and aspiration, it is common for folded blankets to be placed under the head and neck of a patient to raise the angle of the thoracic spine. This helps to create the necessary sniffing angle that is necessary to align the oral, laryngeal, and pharyngeal axes that is critical for successful direct laryngoscopy. Further, the increased angle of the thoracic spine creates a gravitational effect to keep gastric contents within the stomach, thereby decreasing the risk of aspiration. However, the stacking of blankets is inefficient and wasteful in that it requires extensive trial and error to achieve the proper sniffing angle. Further, the stacking of blankets does not provide adequate pressure point padding for the head and neck.

Another problem associated with the use of stacked sheets to achieve and maintain this sniffing angle is that the increased height of the head and neck relative to the arms hyperextends the arms at the shoulder joint. Foam pads are typically placed under the arms to prevent the hyperextension. However, these foam pads are not tall enough to prevent hyperextension of the arms at the shoulder joints.

It is thus highly desirous to optimize positioning of patients during endotracheal intubation to reduce the risk of hypoxia and aspiration. It is also desirous to provide pressure point padding of the head and arms during surgical procedures that may require endotracheal intubation. It is also desirable to prevent hyperextension of the arms at the shoulder joint as a result of the establishment and maintenance of a sniffing angle during endotracheal intubation.

SUMMARY OF THE INVENTION

A wedge pillow is provided that is placed under the patient prior to surgery that may require endotracheal intubation. The wedge pillow raises the angle of the thoracic spine and provides a platform and pressure point padding for the back of the head and neck. The wedge pillow allows excessive and redundant tissue to fall away from the head and neck, thereby allowing excellent positioning, easy access to the oropharynx, and perfect sniffing position, or alignment of the three critical axis (Oral, Laryngeal, and Pharyngeal), that allow for direct visualization of the glottic opening. This reduces the risk of hypoxia and aspiration associated with establishing and maintaining an endotracheal intubation that is typically necessary during general anesthesia surgery.

An extended arm cushion is also provided that may be used in conjunction with the wedge pillow and provides pressure point padding for the arms. The length of the extended arm cushion is formed in a curve, wedge, or half-moon shape that keeps the arm from becoming malpositioned during surgery. The extended arm cushion is typically used in conjunction with the Velcro strap to secure the arm and cushion to the operating table armboard. The armrest cushion prevents or minimizes the amount of hyperextension of the arm at the shoulder joint during surgery.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENTS

To reduce the risk of hypoxia and aspiration during endotracheal intubation that is typically required during general anesthesia surgery, it is common for blankets to be stacked under the head and neck of a patient to raise the angle of the thoracic spine. This helps to create the necessary sniffing angle that is necessary to align the oral, laryngeal, and pharyngeal axes that is critical for successful direct laryngoscopy. Further, the increased angle of the thoracic spine creates a gravitational effect to keep gastric contents within the stomach, thereby decreasing the risk of aspiration. However, the stacking of blankets is inefficient and wasteful in that it requires extensive trial and error to achieve the proper sniffing angle. Further, the stacking of blankets does not provide adequate pressure point padding for the head and neck.

Figure 1:
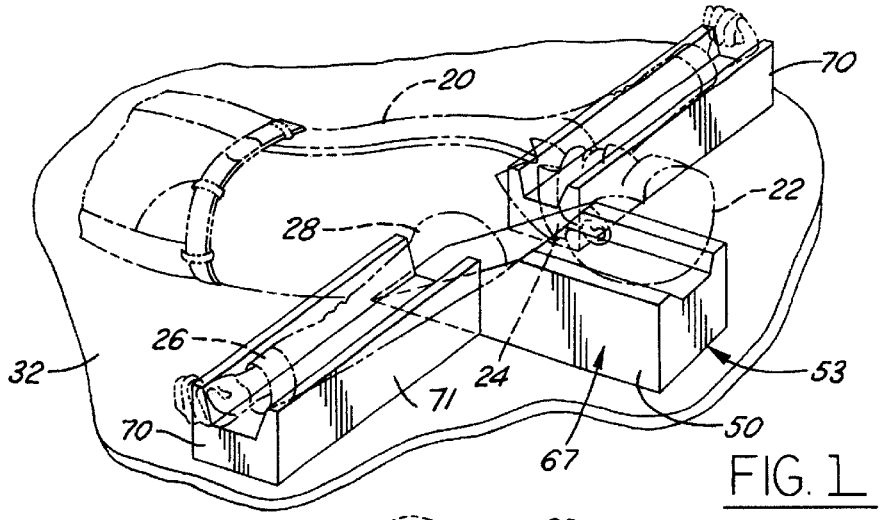
FIG. 1 is perspective view of a patient laying on a wedge pillow and utilizing the armrest cushions according to one preferred embodiment of the present invention.
Figure 2:
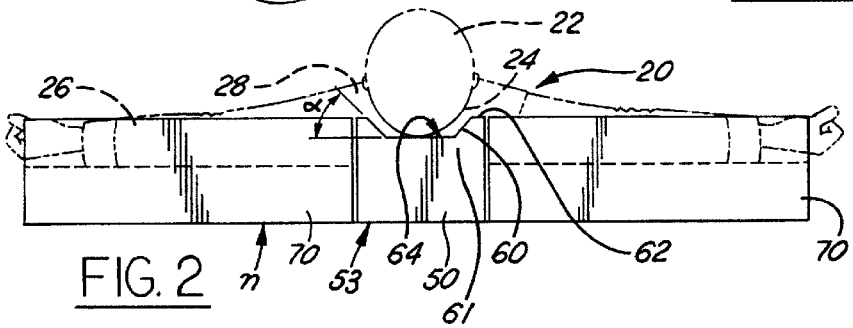
FIG. 2 is an end view of FIG. 1.

FIGS. 1 and 2 illustrate from two different perspectives a preferred embodiment of the present invention, in which a wedge pillow 50 replaces the use of stacked blankets and is placed on an operating table 32 under the patient 20 laying in a supine position prior to endotracheal intubation. The wedge pillow 50 raises the angle of the thoracic spine and provides a platform and pressure point padding for the back of the head 22. This allows excessive and redundant tissue to fall away from the head 22 and neck 24, thereby allowing excellent positioning, easy access to the oropharynx, and perfect sniffing position, or alignment of the three critical axis (Oral, Laryngeal, and Pharyngeal), that allow for direct visualization of the glottic opening. The wedge pillow properly positions the patient 20 on the operating table 32 to reduce the risk of hypoxia and aspiration associated with establishing and maintaining an endotracheal intubation that is necessary during general anesthesia surgery. A detailed description of the features of wedge pillow 50 is shown below in FIG. 3.

There is also shown in FIGS. 1 and 2 a pair of armrest cushions 70 that are used to support the arm 26 and to prevent the arm 26 from becoming malpositioned during surgery. The armrest cushions 70 prevent or minimize the amount of hyperextension of the arm 26 at the shoulder joint 28 during surgery and provide pressure point padding to the arms 26. A detailed description of the features of an extended arm cushion 70 is shown below in FIG. 4.

Figure 3:
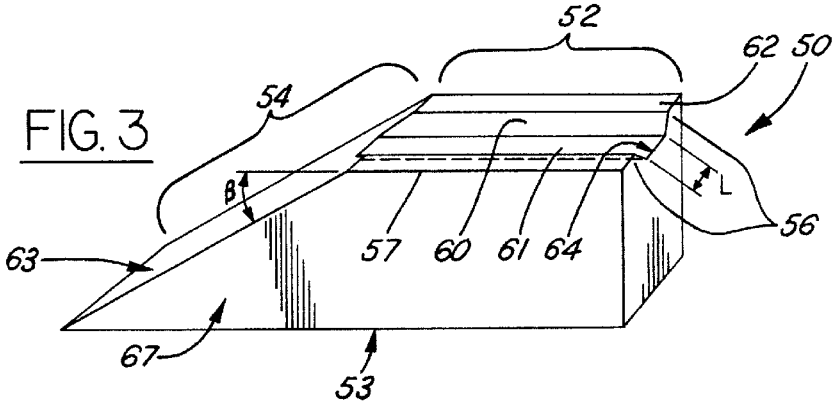
FIG. 3 is a perspective view of the wedge pillow of FIG. 1.

FIG. 3 depicts a wedge pillow 50 shown in FIG. 1 as consisting of a platform portion 52, a bottom portion 53, a pair of sides 67 and a spinal portion 54. The platform portion 52, in conjunction with the spinal portion 54, provides the proper angle of the thoracic spine necessary to provide a proper sniffing position when the bottom portion 53 is placed flat against the operating table 32. As is well known in the art, a sniffing position is required to align the oral, laryngeal, and pharyngeal axis and to allow direct visualization of the glottic opening. This allows for successful direct larygynoscopy. The platform portion 52 also provides a support and pressure point padding for the head 22 and neck 24 of the patient 20.

The platform portion 52 has a recessed inner region 56 that is used to support the head 22 and the neck 24 between a pair of outer raised regions 62. The recessed inner region 56 should have sufficient length 1 to ensure that the head 22 can fit comfortably between the pair of outer raised regions 62.

The recessed inner region 56 has a sidewall 60 extending outwardly and upwardly at an angle $\alpha$ from each end of a flat middle region 61 to a respective outer raised region 62. The angle $\alpha$ is measured between a horizontal plane extending along the upper surface 64 of the flat middle region 61 of the recessed inner region 56 and the sidewall 60 and is sufficiently angled to ensure that the head 22 is maintained between the outer raised regions 62 throughout the course of the surgical procedure. This angle $\alpha$ is preferably between approximately 30 and 90 degrees, thus allowing for a vertical height difference between the upper surface 64 and the top 57 of the outer raised regions 62 of approximately 1–3 inches. In addition, the length 1 of the flat middle region 61 should be sufficiently long to hold the back of the head 22 within the sidewalls 60. Preferably, the length 1 is approximately 6 inches long for a normal full-grown person.

Of course, in other preferred embodiments (not shown), the shape of the recessed inner region 56 could be modified in a wide variety of ways and still fall within the spirit of the present invention and still ensure that the head 22 is maintained between the outer raised regions 62. For example, the recessed inner region 56 could gently slope upwardly in a reverse half moon shape from a low middle region to the outer raised regions 62 and still fall within the spirit of the present invention. While the sides 67 of the wedge pillow 50 are shown in a substantially vertical position in FIGS. 1–3, it is contemplated that they may slope downwardly and outwardly away from the respective raised regions 62 to increase the stability of the wedge pillow 50 on the operating table 32.

As best shown on FIG. 1, an upper spinal surface 63 of the spinal portion 54 slopes downwardly and away from the flat middle region 61 towards the lower portion of the patient 20 at an angle $\beta$, where angle $\beta$ is measured between the horizontal plane defined by an upper surface 64 and the upper spinal surface 63 of the spinal portion 54. The angle $\beta$ is set to effectively align the patient 20 such that the proper sniffing angle of the thoracic spine is achieved for successful direct laryngoscopy. Preferably, angle $\beta$ is set between approximately 15 and 60 degrees relative to the horizontal plane. The length of the spinal portion 54 depends upon the desired height h of the flat middle region 61 above the operating table 32 surface. This height h is also dependent upon the height and body size of the patient 20, but is preferably approximately 9–11 inches above the surface of the operating table 32.

The pillow 50 preferably comprises a high-density open-celled viscoelastic polyurethane foam which may be manufactured through injection molding, or through other methods of manufacture, which are well known in the art. Of course, other materials well known in the art that provides structural support and cushioning to the patient 20 may be used. In addition, a removable cover (not shown) adapted to fit over the body of the pillow 50 may be used. Preferably, the material used in the removable cover comprises a soft cloth material.

Figure 4:
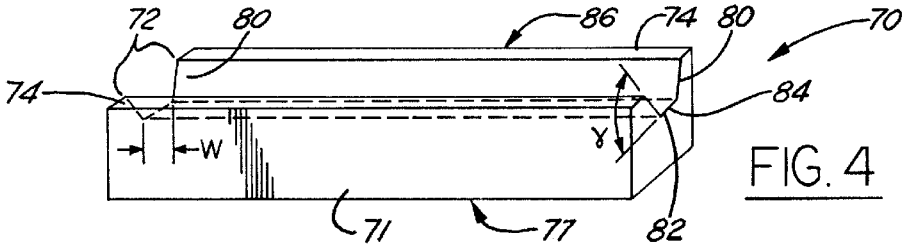
FIG. 4 is a perspective view of one of the armrest cushions of FIG. 1.

Referring now to FIG. 4, each armrest cushion 70 has a recessed central region 72 that is used to support the arm 26 from shoulder to hand between a pair of raised regions 74. The armrest cushion 70 also provides pressure point padding for the arm 26. The armrest cushion 70 also has a pair of sides 71 extending from a bottom region 77 to a respective raised region 74. The recessed central region 72 has a wall 80 extending upwardly at an angle $\gamma$ from each end of a flat central region 82 to a raised region 74. The angle $\gamma$ is measured between a horizontal plane extending along the upper wall surface 84 of the flat central region 82 and the wall 80 and is sufficiently angled to ensure that the arm 26 is maintained between the raised regions 74 throughout the course of the surgical procedure. This angle $\gamma$ is preferably between approximately 30 and 90 degrees, thus allowing for a vertical height difference between the flat central region 82 and the top, 86 of the raised regions 74 of approximately 1–3 inches. The width w of the flat central region 82 should be sufficiently long to hold arm 26 within the sidewalls 80. Preferably, the width w is approximately 2–4 inches long for a normal full-grown person.

Of course, in other preferred embodiments (not shown), the shape of the recessed central region 72 could be modified in a wide variety of ways and still fall within the spirit of the present invention and still ensure that the arm 26 is maintained between the raised regions 74. For example, the recessed central region 72 could gently slope upwardly in a reverse half moon shape from a low middle region to the raised regions 74 and still fall within the spirit of the present invention. While the sides 71 of the armrest cushion are shown in a substantially vertical position in FIGS. 1, 2 and 4, it is contemplated that they may slope downwardly and outwardly away from the respective raised regions 74 towards the bottom region 77 to increase the stability of the armrest cushion on the operating table 32.

The height of the recessed central region 72 and the pair of raised regions 74 of the armrest cushion 70 will vary depending upon the application. For example, in one preferred embodiment as shown in FIG. 1, where the armrest cushion 70 is used in conjunction with the wedge pillow 50, the height of the raised regions 74 substantially matches the height of the outer raised regions 62, thereby preventing hyperextension of the arm 26 at the shoulder joint 28.

However, if the armrest cushion 70 is used independently of the wedge pillow 50, the height of the armrest cushion 70 may vary substantially depending upon a number of factors, including but not limited to the height and weight of the patient and the type of surgical procedure performed. The unique shape and height of the armrest cushions 70 provides cushioning of pressure points of the arms 26 while the patient 20 is unconscious or sedated. The cushions 70 also help to keep the arms 26 from becoming malpositioned during surgery and to prevent the arms 26 from rolling off the armboards of the operating table 32. The extended arm cushions 70 in these applications are typically used in conjunction with the Velcro strap (not shown) to secure the arm 26 and armrest cushion 70 to the operating table 32 armboard.

Similar to the wedge pillow 50, the armrest cushions 70 comprises a high-density open-celled viscoelastic polyurethane foam which may be manufactured through injection molding, or through other methods of manufacture, which are well known in the art. Of course, other materials well known in the art that provides structural support and cushioning to the patient 20 may be used. In addition, a removable cover (not shown) adapted to fit over the body of the armrest cushions may be used. Preferably, the material used in the removable cover comprises a soft cloth material.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features that constitute the essential features of these improvements within the true spirit and the scope of the invention. For example, while the wedge pillow 50 is shown having dimensions for a normal full-grown person, it would be appreciated by one of skill in the art that a smaller or larger dimensional version of the wedge pillow 50 that achieves a proper sniffing angle is contemplated for persons of smaller or larger stature. Thus, a wedge pillow 50 used for small children would have smaller overall dimensions than a pillow for a very tall or large patient 20 while still maintaining a proper sniffing angle. A similar dimensioned armrest cushion 70 for small or large stature patients 20 is also contemplated.

What is claimed is:

1. A wedge pillow used to support and provide pressure point relief to a head and neck of a patient during surgery comprising:

a bottom portion;

a platform portion spaced apart from said bottom portion having a recessed inner region and a pair of outer raised regions; and a spinal portion having an upper spinal surface sloping from said platform portion towards said bottom portion at a first angle, said first angle measured between a horizontal plane defined by an upper surface of said recessed inner region and said upper spinal surface, wherein said first angle of said spinal portion supports the patient in a thoracic spine position that aligns an oral, laryngeal, and pharyngeal axes in a proper sniffing angle.

2. The wedge pillow of claim 1, wherein said first angle is between approximately 15 and 60 degrees.

3. The wedge pillow of claim 1, wherein said recessed inner region comprises a flat middle section coupled between a pair of sidewalls, wherein the length of said flat middle section is sufficient to accept and support the head of the patient between said pair of sidewalls.

4. The wedge pillow of claim 3, wherein each of said pair of sidewalls extends upwardly towards a respective one of said pair of outer raised regions from said flat middle section at a second angle, said second angle measured between said horizontal plane and said sidewall, wherein said second angle is sufficient to ensure that the head of the patient remains on said flat middle section.

5. The wedge pillow of claim 4, wherein said second angle is between approximately 30 and 90 degrees.

6. A support structure for use in general anesthesia surgery comprising:

a wedge pillow used to support and to provide pressure point relief of the head and neck of a patient and to reduce the risk of hypoxia and aspiration associated with endotracheal intubation; and a pair of armrest cushions, each of said pair of armrest cushions used to support and to provide pressure point relief and position a respective arm of said patient, wherein the height of said pair of armrest cushions substantially matches the height of said wedge pillow to prevent hyperextension of said respective arms at the shoulder joint.

7. The support structure of claim 6, wherein said wedge pillow comprises:

a bottom portion;

a platform portion spaced apart from said bottom portion having a recessed inner region and a pair of outer raised regions; and a spinal portion having an upper spinal surface sloping from said platform portion towards said bottom portion at a first angle, said first angle measured between a horizontal plane defined by an upper surface of said recessed inner region and said upper spinal surface, wherein said first angle of said spinal portion supports the patient in a thoracic spine position that aligns an oral, laryngeal, and pharyngeal axes in a proper sniffing angle.

8. The support structure of claim 7, wherein said first angle is between approximately 15 and 60 degrees.

9. The support structure of claim 7, wherein said recessed inner region comprises a flat middle section coupled between a pair of sidewalls, wherein the length of said flat middle section is sufficient to accept and support the head of the patient between said pair of sidewalls.

10. The support structure of claim 9, wherein each of said pair of sidewalls extends upwardly towards a respective one of said pair of outer raised regions from said flat middle section at a second angle, said second angle measured between said horizontal plane and said sidewall, wherein said second angle is sufficient to ensure that the head of the patient remains on said flat middle section.

11. The support structure of claim 10, wherein said second angle is between approximately 30 and 90 degrees.

12. The support structure of claim 7, wherein each of said armrest cushions comprises:

a bottom region;

a recessed central region spaced apart from said bottom region for supporting one of said respective arms, said recessed central region comprising a pair of walls extending upwardly from opposite ends of a flat central region at a third angle, said third angle measured between a second horizontal plane defined by said flat central region and an upper wall surface of each of said walls, said third angle sufficient to ensure that said respective arm of the patient remains on said flat central region; and a pair of raised regions coupled to a respective one of said walls, wherein the height of said pair of raised regions substantially matches the height of said pair of outer raised regions.

13. The support structure of claim 12, wherein said third angle is between approximately 30 and 90 degrees.

14. The support structure of claim 7, wherein said wedge pillow comprises a high-density open-celled viscoelastic polyurethane foam wedge pillow.

15. The support structure of claim 7, wherein said armrest cushions are made of a high-density open-celled viscoelastic polyurethane foam material.

16. A method for properly aligning a patient during surgery to receive endotracheal intubation comprising:

providing a wedge shaped pillow having a bottom portion, a platform portion and a spinal portion, said platform portion spaced apart from said bottom portion, said spinal portion having an upper spinal surface sloping from said platform portion towards said bottom portion at a first angle measured between a horizontal plane defined by an upper surface of said recessed inner region and said upper spinal surface, wherein said first angle of said spinal portion supports the patient in a thoracic spine position that aligns an oral, laryngeal, and pharyngeal axes in a proper sniffing angle;

placing said wedge shaped pillow on an operating table such that said bottom portion lies flat against said operating table;

placing said patient in a supine position onto said operating table such that the head and neck of said patient are positioned on said platform portion and such that the back of said patient is closely coupled with said upper spinal surface of said spinal portion.

17. The method of claim 16, wherein providing a wedge pillow comprises providing a wedge shaped pillow having a bottom portion, a platform portion and a spinal portion, said platform portion spaced apart from said bottom portion, said spinal portion having an upper spinal surface sloping from said platform portion towards said bottom portion at a first angle measured between a horizontal plane defined by an upper surface of said recessed inner region and said upper spinal surface, wherein said first angle of said spinal portion supports the patient in a thoracic spine position that aligns an oral, laryngeal, and pharyngeal axes in a proper sniffing angle and is between approximately 15 and 60 degrees.

18. The method of claim 16 further comprising providing a pair of armrest cushions, wherein the height of said pair of armrest cushions substantially matches the height of said wedge pillow to prevent hyperextension of said respective arms at the shoulder joint; and placing said respective arm of the patient within said recessed central region of a respective one of said pair of armrest cushions, wherein said pair of armrest cushions minimize or prevent hyperextension of each of said respective arms at their respective shoulder joints.

19. The method of claim 18, wherein providing a pair of armrest cushions comprises providing a pair of armrest cushions wherein the height of said pair of armrest cushions substantially matches the height of said wedge pillow to prevent hyperextension of said respective arms at the shoulder joint, wherein each of said armrest cushions comprises:

a bottom region;

a recessed central region spaced apart from said bottom region for supporting one of said respective arms, said recessed central region comprising a pair of walls extending upwardly from opposite ends of a flat central region at a third angle, said third angle measured between a second horizontal plane defined by said flat central region and an upper wall surface of each of said walls, said third angle sufficient to ensure that said respective arm of the patient remains on said flat central region; and a pair of raised regions coupled to a respective one of said walls, wherein the height of said pair of raised regions substantially matches the height of said pair of outer raised regions.

20. The method of claim 19, wherein providing a pair of armrest cushions comprises providing a pair of armrest cushions wherein the height of said pair of armrest cushions substantially matches the height of said wedge pillow to prevent hyperextension of said respective arms at the shoulder joint, wherein each of said armrest cushions comprises:

a bottom region;

a recessed central region spaced apart from said bottom region for supporting one of said respective arms, said recessed central region comprising a pair of walls extending upwardly from opposite ends of a flat central region at a third angle, said third angle measured between a second horizontal plane defined by said flat central region and an upper wall surface of each of said walls, said third angle sufficient to ensure that said respective arm of the patient remains on said flat central region, said third angle between approximately 30 and 90 degrees; and a pair of raised regions coupled to a respective one of said walls, wherein the height of said pair of raised regions substantially matches the height of said pair of outer raised regions.

* * * * *